US009617498B2

(12) United States Patent
Chiddick et al.

(10) Patent No.: US 9,617,498 B2
(45) Date of Patent: Apr. 11, 2017

(54) POSITIVE FRICTION CONTROL COMPOSITION FOR RAILWAYS

(71) Applicant: THE WHITMORE MANUFACTURING CMOPANY, Rockwall, TX (US)

(72) Inventors: Kelvin Chiddick, British Colombia (CA); Alejandro Medrano, Garland, TX (US); Randall Krinker, Garland, TX (US); Kyle Wilson, Garland, TX (US); David Birdwell, Garland, TX (US)

(73) Assignee: Whitmore Manufacturing, LLC, Rockwall, TX (US)

( * ) Notice: Subject to any disclaimer, the term of this patent is extended or adjusted under 35 U.S.C. 154(b) by 0 days.

(21) Appl. No.: 14/655,903

(22) PCT Filed: Jan. 3, 2014

(86) PCT No.: PCT/US2014/010188
§ 371 (c)(1),
(2) Date: Jun. 26, 2015

(87) PCT Pub. No.: WO2014/107581
PCT Pub. Date: Jul. 10, 2014

(65) Prior Publication Data

US 2015/0344802 A1 Dec. 3, 2015

Related U.S. Application Data

(60) Provisional application No. 61/848,596, filed on Jan. 7, 2013, provisional application No. 61/850,690, filed
(Continued)

(51) Int. Cl.
*C10M 173/00* (2006.01)

(52) U.S. Cl.
CPC .... *C10M 173/00* (2013.01); *C10M 2201/041* (2013.01); *C10M 2201/062* (2013.01);
(Continued)

(58) Field of Classification Search
CPC ..... C10M 173/00; C10M 2201/0663; C10M 2201/103; C10M 2201/041;
(Continued)

(56) References Cited

U.S. PATENT DOCUMENTS 4,115,282 A 9/1978 Grasshoff
4,915,856 A 4/1990 Jamison
(Continued)

FOREIGN PATENT DOCUMENTS

JP 2010059274 3/2010
WO WO2004096960 * 11/2004

OTHER PUBLICATIONS

Daniel Szablewski, Richard Reiff, "FAST Testing of Latest Top-of-Rail Friction Modification Materials", Technology Digest, TD-13-0xx, Copyright Dec. 2013, Transportation Technology Center, Inc., pp. 1-4.

(Continued)

*Primary Examiner* — Cephia D Toomer
(74) *Attorney, Agent, or Firm* — John Wilson Jones; Jones Delflache LLP

(57) ABSTRACT

A friction control composition having high and positive factional properties for sliding steel surfaces includes a water insoluble hydrocarbon that enables a reduced water content, a rheological additive, a freezing point depressant, a friction modifier, and a lubricant.

21 Claims, 4 Drawing Sheets

Related U.S. Application Data on Feb. 21, 2013, provisional application No. 61/850,923, filed on Feb. 26, 2013, provisional application No. 61/958,789, filed on Aug. 6, 2013, provisional application No. 61/962,265, filed on Nov. 4, 2013, provisional application No. 61/963,448, filed on Dec. 4, 2013.

(52) U.S. Cl.
CPC ..... *C10M 2201/066* (2013.01); *C10M 2201/0663* (2013.01); *C10M 2201/084* (2013.01); *C10M 2201/103* (2013.01); *C10M 2203/1025* (2013.01); *C10M 2205/0285* (2013.01); *C10M 2207/0225* (2013.01); *C10M 2207/32* (2013.01); *C10M 2207/401* (2013.01); *C10N 2220/082* (2013.01); *C10N 2230/06* (2013.01); *C10N 2240/00* (2013.01); *C10N 2250/10* (2013.01); *C10N 2250/12* (2013.01)

(58) Field of Classification Search
CPC ..... C10M 2201/062; C10M 2201/066; C10M 2201/084; C10M 2203/1025; C10M 2205/0285; C10M 2207/0225; C10M 2207/32; C10M 2207/401; C10N 2220/082; C10N 2230/06; C10N 2240/00; C10N 2250/10; C10N 2250/12
See application file for complete search history.

(56) References Cited

U.S. PATENT DOCUMENTS

| | | | |
|---|---|---|---|
| 5,173,204 | A | 12/1992 | Chiddick et al. |
| 5,213,697 | A | 5/1993 | Vinci et al. |
| 6,136,757 | A | 10/2000 | Chiddick |
| 6,328,143 | B1 | 12/2001 | Shute et al. |
| 6,759,372 | B2 | 7/2004 | Cotter |
| 6,854,908 | B2 | 2/2005 | Hui et al. |
| 6,855,673 | B2 | 2/2005 | Cotter et al. |
| 7,045,489 | B2 | 5/2006 | Cotter et al. |
| 7,160,378 | B2 | 1/2007 | Eadie et al. |
| 7,244,695 | B2 | 7/2007 | Eadie |
| 7,939,476 | B2 | 5/2011 | Eadie et al. |
| 8,305,567 | B2 | 11/2012 | Hesser et al. |
| 8,473,128 | B2 | 6/2013 | Oldknow et al. |
| 8,492,474 | B2 | 7/2013 | Gallucci et al. |
| 2004/0038831 | A1 | 2/2004 | Eadie |
| 2010/0105583 | A1 | 4/2010 | Garmier |
| 2011/0059876 | A1 | 3/2011 | Takahama et al. |
| 2011/0190177 | A1 | 8/2011 | Zaki |
| 2013/0331589 | A1 | 12/2013 | Raczkowski et al. |

OTHER PUBLICATIONS

H. Tanaka, A. Furukawa, "The estimation method of wheel load and lateral force using the axlebox acceleration", Railway Technical Research Institute, Tokyo, Japan, Dated at least as early as Jan. 2, 2014, pp. 1-10.

* cited by examiner

POSITIVE FRICTION CONTROL COMPOSITION FOR RAILWAYS

REFERENCE TO RELATED APPLICATIONS

The present utility patent application claims priority to the following provisional patent applications: Friction Modifier Composition for Rail Tracks, Ser. No. 61/848,596 filed on Jan. 7, 2013; Friction Modifier Composition for Rail Tracks, Ser. No. 61/850,690, filed on Feb. 21, 2013; Friction Modifier Composition for Rail Tracks, Ser. No. 61/850,923, filed on Feb. 26, 2013; Friction Modifier with High and Positive Characteristics, Ser. No. 61/958,789 filed on Aug. 6, 2013; Friction Modifier with High and Positive Characteristics, Ser. No. 61/962,265 filed on Nov. 4, 2013; and Friction Modifier with High and Positive Characteristics, Ser. No. 61/963,448 filed on Dec. 4, 2013.

FIELD OF INVENTION

The present invention relates to friction control compositions with high and positive frictional properties for controlling friction in a positive manner between two sliding steel surfaces, namely steel wheels on steel rails in the railway industry.

BACKGROUND OF THE INVENTION

Steel transport wheels and steel rails have many issues that require the control of friction between the two surfaces. Failure to control the friction in a positive manner can result in noise problems, extensive wear and sub-optimum performance (from art efficiency standpoint) caused by slip-stick oscillations due to negative friction between the two sliding steel surfaces. Accordingly, friction modifiers with high and positive friction to control sliding and rolling-sliding contact in steel-rail and steel-wheel transportation systems are well known in the art. Various patents from Kelsan Technologies describe friction modifier compositions (see, U.S. Pat. Nos. 6,759,372; 6,855,673; 7,045,489; 7,160,378; 7,244,695 and 7,939,476). These patents describe a water-based system commercialized by Kelsan.

However, there are various problems with some of these water based friction modifier products. Examples of the problems are set out below:

When ammonia is used in the water-based systems it can cause equipment to rust. Latex can cause problems with the gears and other movable mechanical parts as the compositions dry out. These compositions can form a skin over the liquid when it is pumped onto the rail head and the product is allowed to dry before taken up by a train wheel in a short period of time, and this can cause flowing out or splashing when contacted by the wheels of the train and accordingly not be carried down the track by the wheels of the train.

What is needed is a friction modifier composition for top of rail applicators that helps prevent rust on equipment with which it comes into contact.

Another object of the invention is to eliminate the latex skin on the prior art compositions such that the product when applied does not have a skin but instead forms a soft, non-drying deposit on the rail head. This soft non-drying deposit is picked up by the train wheel and carried down the rail to form a continuous film which controls the friction between the wheel and the rail is a positive manner.

In accordance with a further object of the invention, the friction control composition is embodied as a thixotropic gel or liquid that is thinned by shear and returns to its thicker more viscous state under static conditions. The thixotropy of the composition is used to facilitate application to the rail and to promote retention on the rail in its thicker state without formation of a skin. Unlike the prior art compositions discussed above, the composition does not form a skin over a low viscosity fluid that is ejected or pushed away by the rolling contact of the train wheels. Thus, the composition may be mixed for liquid-like flow during application to the rail as by conventional rail-mounted pump systems. Following rail application, the composition thickens under static conditions without drying or forming a skin, and remains positioned on the rail until sheared by train wheel engagement for distribution along the track during "carry down".

Another object of the invention is to have freezing point depressant that does not degrade the rheology of the composition.

Yet another object of the invention is to have a composition that causes the thickener (e.g. the clay) to go into a matrix such that it has improved dispersability.

Also, solid stick prior art compositions, such as the one described in, U.S. Pat. No. 4,915,856, are well known in the art. But these solid stick friction modifiers have their own problems such as expense, and they need mechanical brackets and applicators to apply the product to the wheel. With solid stick compositions, practicality of use and duration of efficacy can also be a problem on freight trains.

Another object of the invention is to change the sliding friction from negative to positive.

Another object of the invention is to reduce noise by reducing or eliminating slip-stick oscillations between the wheel and rail.

Another object of the invention is to reduce lateral creep, which reduces lateral forces by changing the friction from negative to positive between the wheel and rail when a train, especially a freight train, goes through a curve. The benefits of reducing lateral forces include increasing the stability of the train as it travels down the track and in a related manner there is a reduction of the wear on the rail head, rail ties, and tie plates. Also, the bogey or truck goes around the curve in a much smoother fashion with reduction in jerking and jumping movement.

Another object of the invention is to reduce longitudinal creep wherein the wheel is sliding forward such as occurs in a transit system when the wheel is going around a mild curve. In longitudinal creep, if the wheels go slightly off-kilter, the locomotive pulls the wheel and the wheel slides in the longitudinal direction. If this creep happens all the time, you get short pitch corrugations. These are wear marks on the rail head in the nature of corrugations as encountered in a dirt road. By reducing this creep, the wheel will not slide as far and short pitch corrugations are inhibited.

Another object of the invention is to reduce spin creep wherein there is instability between the wheel and the rail, and the wheel is almost making a small circle on the top of the rail head.

The friction control compositions of the present invention reduce, if not eliminate, these three different types of creep by changing negative friction to positive friction. Lateral forces are one of the main problems in the heavy haul railroad in North America, and it is preferably reduced in accordance with the present invention. Similarly, longitudinal creep is reduced, if not eliminated, in order to inhibit the formation of short pitch corrugations in the rail. The reduction or elimination of spin creep is also desirable in order to reduce wear on the wheel and rail.

All of these creeps are small and are, for example, in the micron size range. The friction control compositions herein are effective to change the friction from negative to positive and thereby reduce or eliminate creep and the accompanying stick-slip.

SUMMARY OF THE INVENTION

The present invention relates to novel friction control compositions. More particularly, the present invention relates to friction control compositions that may be applied to steel-rails or steel-wheels that are potentially in sliding or rolling-sliding contact with each other.

The friction control compositions change the friction, or coefficient of friction, between the steel surfaces from negative to positive and thereby reduce or eliminate the lateral, longitudinal and/or spin creeps with a corresponding reduction or elimination of lateral forces and wheel-rail wear while increasing stability of the train.

In accordance with preferred embodiments of the invention, the skin forming retentivity agents of the Kelsan patents, supra, are avoided since skin formation is believed to inhibit uniform thixotropic properties, effective shear of the applied composition upon train wheel passage, and the achievement of improved carry down. Accordingly, the present compositions preferably rely upon the thixotropic properties to facilitate application of the composition, maintenance of position of the applied composition and subsequent train wheel shear to provide viscosities desirable for distribution of increased amounts of composition over longer carry down distances.

The preferred liquid embodiments of the friction control compositions include a reduced amount of water compared with prior art liquid compositions. The water content is reduced by the use of a water insoluble hydrocarbon found to further enhance the stability of the friction control composition.

The friction control compositions herein are described in greater detail with reference to illustrative compositions. Compositional percentages are in weight percent (w/w %) unless otherwise specified.

The inventive friction control compositions for use on top of rail applications comprise:

(a) from about 4 to about 40 w/w % water;
(b) from about 2 to about 20 w/w % rheology additive;
(c) from about 10 to about 40 w/w % water insoluble hydrocarbon;
(d) from about 10 to about 40 w/w % water soluble polyalcohol freezing point depressant;
(e) from about 9 to about 24 w/w % liquid or solid friction modifier; and
(f) from about 1 to about 20 w/w % liquid or solid lubricant.

Optionally, the composition may also contain one or more of:

(g) from 1 to 3 w/w % surfactant or wetting agent
(h) from 0.1 to 0.5 w/w % corrosion inhibitor, and/or
(i) from 0.05 to 0.2 w/w % biocide/fungicide agent In preferred embodiments, the friction control compositions consist essentially of the foregoing components and, accordingly, the formation of a skin and the skin forming retentivity agents of the Kelsan patents, supra, are preferably avoided in favor of the thixotropic properties in the present compositions. Thus, the preferred compositions herein are substantially free of the film-forming retentivity agents described in the Kelsan patents as being selected from the group consisting of acrylic, polyvinyl alcohol, polyvinyl chloride, oxazoline, epoxy, alkyd, urethane acrylic, modified alkyd, acrylic latex, acrylic epoxy hybrids, polyurethane, styrene acrylate, and styrene butadiene based compounds.

In preferred compositions, the water insoluble hydrocarbon is selected from the group consisting of isoparaffins, vegetable oils, bio-based triglycerides and fatty oils.

According to the present invention, another embodiment of the friction control, composition comprises:

(a) from 15 to 29 w/w % water
(b) from 4 to 13 w/w % rheology additive
(c) from 11 to 28 w/w % water insoluble hydrocarbon (e.g. isoparaffins, vegetable oils, bio-based triglycerides or fatty oils).
(d) from 22 to 40 w/w % freezing point depressant
(e) from 9 to 24 w/w % liquid or solid friction modifier
(f) from 1 to 6 w/w % liquid or solid lubricant.

As noted above, the composition may also optionally contain one or more of:

(g) from 1 to 3 w/w % surfactant or wetting agent
(h) from 0.1 to 0.5 w/w % corrosion inhibitor, and/or
(i) from 0.05 to 0.2 w/w % biocide/fungicide agent Because of some of the problems with water-based systems, various other compounds were experimented with as a partial replacement of water. It has been found that adding a water insoluble hydrocarbon to the composition (e.g. an isoparaffin such as SOTROL 220) helps depress the freezing point and also helps stabilize or even improve the rheology of the formulation. This is especially true when the water insoluble hydrocarbon is compared with other freezing point depressants such as glycerin. Other water insoluble hydrocarbons that have environmental advantages over isoparaffins are vegetable oils, bio-based triglycerides and fatty oils such as canola oil. The oils do not have the same freezing point advantages as isoparaffins but they are environmentally friendly.

The addition of the water insoluble hydrocarbon (either isoparaffins or oils) in the partially water based system is counterintuitive because one would have guessed that it would not mix well with the water and would in all likelihood separate. However, we believe that the clay has receptor sites that allow the water insoluble hydrocarbon to bind onto the clay and keep the final product homogenous. The result is a composition that may contain lower amounts of water and in the case of isoparaffins lower amounts of soluble polyalcohol freezing point depressants such as glycerine. As pointed out above, water based systems have problem with maintenance of the system and typical freezing point depressants can cause negative rheology effects on the composition.

DETAILED DESCRIPTION OF THE INVENTION

Figure 1:
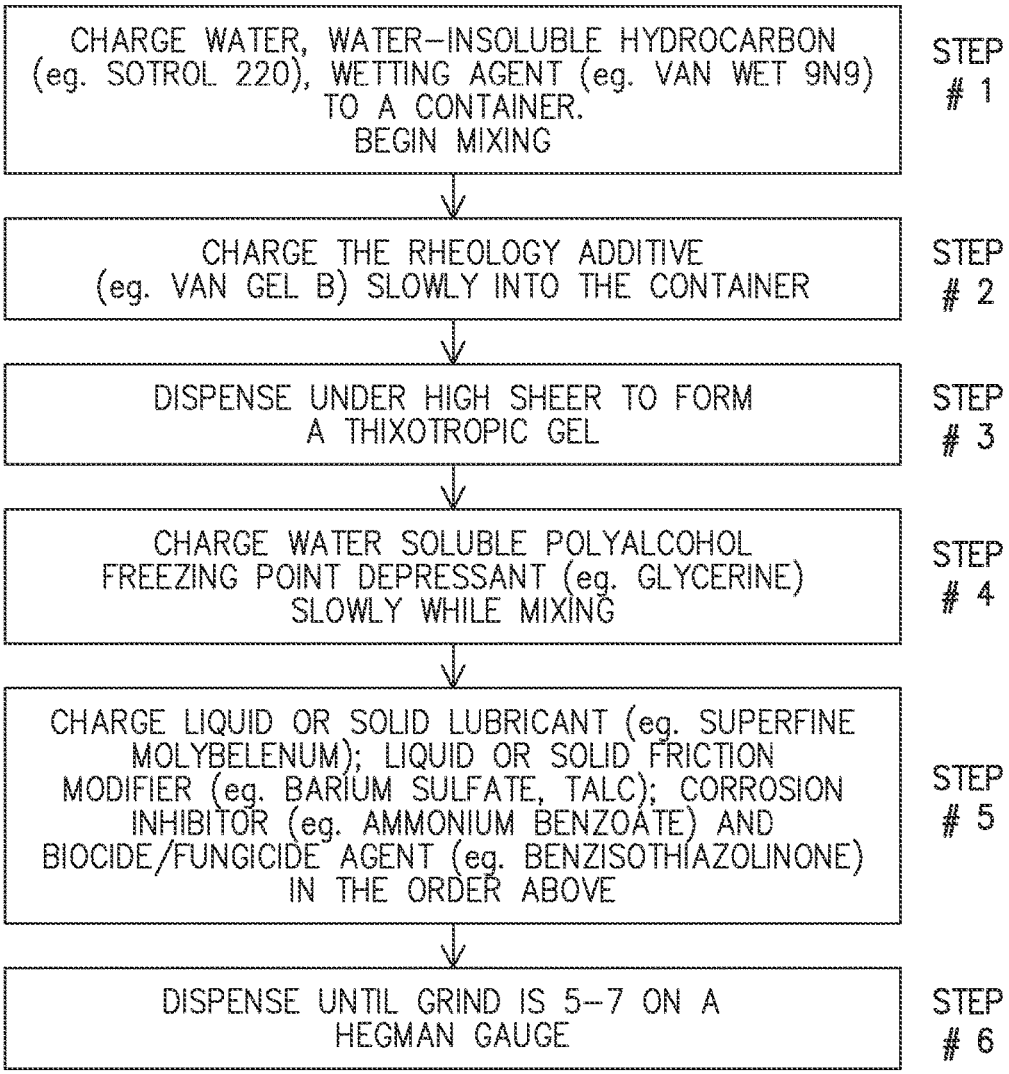
FIG. 1 shows a diagram of the process for making one of the embodiments of the friction control compositions disclosed herein.

Turning now to FIG. 1, the composition can be made in a batch process by adding the various components and then mixing them. Details of various methods of making the compositions are laid out in the examples below.

FIG. 1 shows the process steps graphically. In step 1, charge water, water-insoluble hydrocarbon (e.g. SOTROL 220) and a wetting agent (e.g. VAN WET 9N9) into a batch container. In step 2 slowly charge the rheology additive (e.g. VAN GEL B, lime) into the container. In step 3 this mixture is dispersed under high sheer to form a thixotropic gel. In step 4 slowly charge a water soluble polyalcohol freezing point depressant (e.g. glycerine) while mixing the composition. Step 5 requires adding the following components into the mixture while stirring: liquid or solid lubricant (e.g. superfine molybdenum, carbon black); liquid or solid friction modifier (e.g. barium sulfate and talc); corrosion inhibitor (e.g. ammonium benzoate); and biocide/fungicide (e.g. benzisothiazolinone). In step 6 this mixture is dispersed until grind is 5-7 micrometers on the Hegman gauge.

In the mixing process, the composition is formed as a thixotropic gel or liquid. The thixotropic composition may be mixed or otherwise sheared to reduce its viscosity and increase it flow properties to values sufficient for application as a liquid to the rail head using conventional pump systems. For example, the viscosity achieved by mixing may be in the range of from about 5,000 to about 15,000 cP as measured using a Brookfield viscometer in accordance with ASTM D 2983-02a. More preferably, the shear-mixed viscosity may be in the range of from about 8,000 to about 12,000 cP. The viscosity range may reflect the particular mode of application to the rail, and the foregoing range has been found satisfactory for pumping, spraying and other application techniques.

Upon termination of mixing and shear, the composition has a static thickness or cone penetration consistency in the range of from about 300 to about 400 tenths of a millimeter as measured using a standard cone test in an unworked condition in accordance with ASTM D 217-97. More preferably, the cone penetration may range from about 355 to about 375 tenths of a millimeter. The static thickness or cone penetration consistency may be varied to reflect weather conditions.

The foregoing thixotropic properties have been found to sufficient to allow ease of rail application and increased distribution or "carry down" along the rail road track as compared with prior art friction modifier formulations.

By the term "water-insoluble hydrocarbon" we mean hydrocarbons that are not typically miscible in water based solutions. The insoluble hydrocarbon has a solubility in water of less than or equal to 10 wt %, or even more specifically, less than or equal to 5 wt %, or even more specifically, less than or equal to 1 wt %, at ambient conditions of about 70° F. and one atmosphere of pressure. Examples of such a water-insoluble hydrocarbon include isoparaffins such as SOTROL 220 (C13-C16 isoalkanes) and vegetable oils such as refined canola oil. Other potential water-insoluble hydrocarbons include bio-based triglycerides, fatty oils, poly alpha olefins such as DURASYN 162 and SYNFLUID PAO2, and synthetic esters such as di-octyl adipate and isopropyl oleate.

It has been found that the water-insoluble hydrocarbon gives the composition surprising advantages over water. Water based systems contain ammonia and this can cause equipment to rust. Also latex in water-based systems can cause problems with gears and other movable mechanical parts as the compositions dry out. Finally, the skin that can form over water based systems can cause flowing out or splashing when contacted by the wheels of the train and accordingly the friction modifier compound is then not carried down the track by the wheels of the train. Less water in the composition can help with all of these problems. We have found that replacing some of the water with a water-insoluble hydrocarbon is advantageous.

In the past as people have tried to lower the level of water in their friction control compositions they have at times attempted to replace some of the water with freeze depressants such as glycerine. However, this has the drawback that high amounts of water soluble polyalcohol freezing point depressants (e.g. glycerine) can have negative effects on the friction modifier composition since these type of freezing point depressants can cause rheology problems as the thickeners (e.g. clays) do not remain in the homogenous system.

We have found that replacing some of the water with a water-insoluble hydrocarbon (e.g. SOTROL 220) can improve the overall composition by eliminating or minimizing the negative effects set out above. The addition of a water-insoluble hydrocarbon into the system is counterintuitive since by definition a water-insoluble hydrocarbon should not mix well with a composition containing water. However, surprisingly we found that certain water-insoluble hydrocarbons (e.g. SOTROL 220 and refined canola oil) mix well with the compositions described herein because the water-insoluble hydrocarbon goes into a matrix with the clay in the composition.

By the term "friction modifier" we mean a solid powder which changes the coefficient of friction, in this case, from negative to positive. Examples of such liquid or solid friction modifiers include talc and barium sulfate. The friction modifiers can be chosen from the following list of friction modifiers, but are not limited to these friction modifiers, WHITING (calcium carbonate), BLANC FIXE (calcium sulphate), mineral fibre, wallastonite powder, powdered cashew nut shells, calcium carbonate, aluminum oxide, amorphous silica, silica oxide, magnesium, oxide, magnesium carbonate, lead oxide and coal coke.

By the term "liquid or solid lubricant" we mean a liquid or solid material that reduces friction between two sliding metal surfaces. Examples of two preferred lubricants are superfine molybdenum disulfide and carbon black (in some embodiment used in combination with one another). A non-exclusive list of other potential liquid or solid lubricants includes graphite and zinc stearate. However this invention is not limited to these lubricants only.

By the term "wetting agent" we mean a surfactant which assists the liquid to wet out the solids in the formula. One preferred example of such a wetting agent includes Triton X-100. A non-exclusive list of other potential wetting agents include, UNIVAR propylene carbonate technical", CO630, TEXAANOL, and TEXAPON P, By the term rheology agent we mean a clay or other substance that expands in water to produce a thixotropic mix. An example of one such rheology agents comprises clay such as VAN GEL B. Another example of a rheology agent usable with clay is hydrated lime. A non-exclusive list of other potential rheology agents includes methyl ethyl hydroxy cellulose and ethyl hydroxy cellulose.

By the term freezing point depressant we typically mean an alcohol which when mixed with water, lowers the freezing point of water. One preferred example of such freezing point depressant includes SUPER KPO glycerine. A non-exclusive list of other potential freezing point depressants includes ethyl alcohol, methyl alcohol, isopropanol and butanol.

There are multiple ways of making the friction control composition disclosed herein. In one embodiment the composition typically comprises a) from about 15 to about 29 weight percent water; b) from about 1 to about 3 weight percent surfactant or wetting agent (e.g. propylene carbonate); c) from 1 to about 6 weight percent liquid or solid lubricant (e.g. molybdenum disulfide and carbon black); d) from about 1 to about 10 weight percent rheological control agent (e.g. clay and lime); (e) from about 11 to 28 percent water insoluble hydrocarbon (e.g. SOTROL 220 or canola oil) (f) from about 22 to 40 weight percent freezing point depressant (e.g. glycerine); (g) from about 9 to 24 weight percent liquid or solid friction modifier (e.g. talc and barium sulfate (h) anti-rust composition from about 0.1 to 0.5 (e.g. COUNTER RUST 267®); and (i) from about 0.05 to 0.2 weight percent biocide or fungicide agent (e.g. nitrobutylmorpholine).

The following Examples 1 to 6 illustrate other preferred friction control compositions in accordance with the invention comprising:

(a) from 24 to 25 w/w % water
(b) from 4 to 7 w/w % rheology additive
(c) from 14 to 18 w/w % water insoluble hydrocarbon (e.g. isoparaffins, vegetable oils, bio-based triglycerides or fatty oils).
(d) from 22 to 32 w/w % freezing point depressant
(e) from 14 to 18 w/w % liquid or solid friction modifier
(f) from 2 to 3 w/w % liquid or solid lubricant
(g) from 1 to 3 w/w % surfactant or wetting agent
(h) from 0.2 to 0.5 w/w % corrosion inhibitor
(i) from 0.1 to 0.2 w/w % biocide/fungicide agent In one embodiment of the invention (See Example 5), it has been found that adding a water insoluble hydrocarbon (as a non-exclusive example paraffinic or isoparaffinic solvent SOTROL 220) helps depress the freezing point and also helps stabilize or even improve the rheology of the formulation. This is especially true when the water insoluble hydrocarbon is compared with other freezing point depressants such as glycerin. The addition of the water insoluble hydrocarbon is counterintuitive because one would have guessed that it would not mix well with the water based formulation of this invention and would in all likelihood separate. However, we believe that the clay has receptor sites that allow the water insoluble hydrocarbon to bind onto the clay and keep the final product homogenous.

In yet another embodiment of the invention (see Examples 1-4) it has been found that adding a vegetable oil (as a non-exclusive example, refined canola oil) has some of the advantages of paraffins or isoparaffins such as SOTROL 220 but also include environmental advantages such as having a higher flash point and being biodegradable.

In yet another embodiment of the invention (see Examples 2-3) it has been found that adding carbon black has some advantages. Carbon black was originally added as a solid lubricant to the formulation in order to lower the costs by using a less expensive lubricant than molybdenum disulfide. However, in addition to lowering of the cost of the formulation, it was surprisingly found that carbon black also helps with the stability of the composition (i.e. less separation) and can give a surprising increase in viscosity which in some embodiments is also very helpful. The carbon black can be added in ranges from 0.5 to 5%.

In yet another embodiment of the invention (see Example 1) we use an aprotic solvent exhibiting limited water solubility (e.g. propylene carbonate, solubility in water is 17.5% at 25° C.) rather than the high amounts of glycerine used in other examples set forth infra. The propylene carbonate causes the thickener (e.g. the clay) to go into a matrix such that it has better solubility and can result in a higher friction product than can be achieved with glycerine. The propylene carbonate also helps as a freeze point depressant and improves product efficacy at lower temperatures.

In yet another embodiment of the invention (see Example 7) it may be desirable in certain cold weather environments (e.g. at or below about negative 40 degrees centigrade) for the formulation to contain much higher amounts of freezing point depressants such as glycerine or propylene glycol. In these extremely cold weather environments it may be desirable to replace some (or even all) of the water insoluble hydrocarbons with a freezing point depressant. In at least one embodiment for the cold weather composition the ratio of the glycerine to water shall be at least 63% glycerine to 37% water. For other freezing depressants the ratio of the depressant to water may differ as a function of the freezing point curve. Based upon the freezing point behaviors of these fluid blends they are commonly called eutectic mixtures. Propylene glycol:water mixtures maintain freezing points at or lower than −40° at any ratio of 55% or more propylene glycol. The ratio of glycerine:water shall be within the range of 63-70% glycerine for cold temperature flow down to −40° F.

EXAMPLE 1

The Amounts Below are Weight Percent

Add UNIVAR propylene carbonate technical 2.0
to tap water 24.0
in the vat and stir at slow speeds.
Add first portion of VAN GEL B (clay) 4.5
slowly while stirring for 30 min. under cowls mixer at high speeds.
Add SUPER KPO glycerine slowly 31.6
and mix at high speed for 10 min.
Add a second portion of VAN GEL B (clay) 2.5
slowly while stirring for 30 min. under cowls mixer at high speeds.
Add slowly refined canola oil AGRIPURE 60 17.8
and mix for 15 minutes at high speed.
Add in order while stirring,
molybdenum disulfide THOMPSON CREEK SUPERFINE 3.0
and mix at high speed for 15 minutes.
Add barytes, barium sulfate BARIMITE XF 3.0
and mix at high speeds for 15 minutes.
Add talc, magnesium silicate NICRON 604 11.3
and mix at high speeds for 15 minutes.
Add COUNTER RUST LT-267 0.2
and mix at medium speeds for 15 minutes.
Add anti-fungus, nitrobutylmorpholine BIOBAN P 1487 0.1 and mix at medium speed for 15 minutes.
Disperse until grind is 5-7 on the Hegman gauge.

EXAMPLE 2

Add tap water to vessel 24.0
stir at low speeds.
Add first portion of VAN GEL B (clay) 4.5
slowly while stirring under cowls mixer at high speeds.
Add wetting agent, TRITON X-100 to mixture 2.0
Add SUPER KPO glycerine slowly 29.5
and mix at high speed for 10 min.
Add second portion of VAN GEL B (clay) 2.5
slowly while stirring for 30 min. under cowls mixer at high speeds.
Add slowly refined canola oil AGRIPURE 60 14.6
And mix for 15 minutes at high speed.
Add in order while stirring,
molybdenum disulfide THOMPSON CREEK SUPERFINE 2.0
And mix at high speed for 15 minutes.
Add barytes, barium sulfate BARIMITE XF 3.0
and mix at high speeds for 15 minutes.
Add talc, magnesium silicate NICRON 604 15.0
and mix at high speeds for 15 minutes.
Add carbon black 2.5
and mix at high speeds for 15 minutes.
Add COUNTER RUST LT-267 0.2
and mix at medium speeds for 15 minutes.
Add anti-fungus, K 80078 0.2
and mix at medium speeds for 15 minutes.
Disperse until grind is 4-8 on the Hegman gauge.

EXAMPLE 3

Add tap water to vessel 25.0
stir at low speeds.
Add first portion of VAN GEL B (clay) 4.5
slowly while stirring under cowls mixer at high speeds.
Add wetting agent, TRITON X-100 to mixture 2.5
Add SUPER KPO glycerine slowly 27.9
and mix at high speed for 10 min.
Add second portion of VAN GEL B (day) 2.5
slowly while stirring tor 30 min. under cowls mixer at high speeds.
Add slowly
refined canola oil AGRIPURE 60 14.6
and mix for 15 minutes at high speed.
Add in order while stirring,
molybdenum disulfide THOMSON CREEK SUPERFINE 2.0
And mix at high speed for 15 minutes.
Add barytes, barium sulfate BARIMITE XF 3.0
and mix at high speeds for 15 minutes.
Add talc, magnesium silicate NICRON 604 15.0
and mix at high speeds for 15 minutes
Add carbon black 2.5
and mix at high speeds for 15 minutes.
Add hydrated lime, $Ca(OH)_2$ 0.1
And mix at high speeds for 15 minutes.
Add COUNTER RUST LT-267 0.2
and mix at medium speeds for 15 minutes.
Add anti-fungus, PROXEL GXL Antimicrobial 0.2
and mix at medium speeds for 15 minutes.
Disperse till grind is 4-8 on the Hegman gauge.

EXAMPLE 4

Add tap water to vessel 24.0
and stir at low speeds.
Add first portion of VAN GEL B (clay) 4.5
slowly while stirring under cowls mixer at high speeds.
Add wetting agent, TRITON X-100 to mixture 2.0
Add SUPER KPO glycerine slowly 28.5
and mix at high speed for 10 min.
Add second portion of VAN GEL B (clay) 2.5
slowly while stirring for 30 min. under cowls mixer at high speeds.
Add slowly
refined canola oil AGRIPURE 60 17.8
and mix for 15 minutes at high speed.
Add in order while stirring,
molybdenum disulfide THOMPSON CREEK SUPERFINE 3.0
and mix at high speed for 15 minutes.
Add barytes, barium sulfate BARIMITE XF 3.0
and mix at high speeds for 15 minutes.
Add talc, magnesium silicate NICRON 604 11.3
And mix at high speeds for 15 minutes
Add COUNTER RUST LT-267 0.2
and mix at medium speeds for 15 minutes.
Add anti-fungus, PROXEL GXL antimicrobial 0.2
and mix at medium speeds for 15 minutes
Disperse until grind is 4-8 on the Hegman gauge.

EXAMPLE 5

Add TRITON X-100 1.0
and tap water 24.0
into the vat and stir.
Add slowly VAN GEL B (clay) 4.6
while stirring under cowls mixer, it will become very thick.
Add slowly while stirring
isoparaffinic solvent SOTROL 220 30.0
When well dispersed, add glycerol 22.0
slowly while stirring,
check that product is still thixotropic.
Add in order while stirring,
molybdenum disulfide superfine grade, 2.0
barium sulfate, 3.0
talc, 12.5
hydrated lime, 0.2
COUNTER RUST LT-267, 0.5
K 78 biocide (1:10 dilution) 0.2
Disperse until grind is 5-7 on the Hegman gauge.

EXAMPLE 6

Add tap water 25.0
into the vat and stir.
Add VAN GEL B (clay) 2.5
and GARAMTIE clay 1.5
Add TRITON X-100 2.0
Add slowly while stirring under cowls mixer, it will become very thick.
Add glycerol slowly while stirring, 31.5
Add in order while stirring,
molybdenum disulfide superfine grade, 2.0
barium sulfate, 3.0
talc 15.0
carbon black, 2.5
COUNTER RUST LT-267, 0.2
PROXEL antimicrobial 0.2
Add in canola oil 14.6
Disperse until homogeneous.

In the forgoing examples, the above mentioned thixotropic properties are achieved. That is, the shear-mixed composition has a thickness or viscosity in the range of from about 8,000 to about 12,000 cP to facilitate application to the rail using conventional techniques. The static composition has a thickness or cone penetration consistency of from about 355 to about 375 to maintain the composition on the rail for subsequent carry down by train wheel passage.

EXAMPLE 7

Add TRITON X-100 2.0
and tap water 25.0
into the vat and stir.
Add VAN GEL B (clay) 2.0
GARAMITE (clay) 2.0
When well dispersed, add glycerol 46.0
slowly while stirring,
check that product is still thixotropic,
Add in order while stirring,
molybdenum disulfide superfine grade 2.0
barium sulfate 3.0
talc 15.0
hydrated lime 0.1
carbon black 2.5
COUNTER RUST LT-267 0.2
K 78 biocide (1:10 dilution) 0.2

Disperse until grind is 5-7 on the Hegman gauge.

Performance data using the friction control compositions disclosed herein have confirmed the compositions to be surprisingly more effective than prior art top of rail friction composition modifiers. In the following tests, "fresh" trains having 286,000 pound loaded coal cars passed over an applicator arranged to apply the composition of Example 2. The applicator was mounted to the field side of the track and pumped the shear-mixed liquid composition onto the rail head in a conventional manner and amount ahead of the test curve in the track. The composition returns to its static condition on the rail prior to engagement with the train wheels. The trains are "fresh" in that the wheels were not previously treated, but rather, the wheels were dry and had contaminants typically encountered in train transportation. The product is picked-up by the wheels and carried in the wheel-rail "contact patch" down the track to the curve to provide the benefits of the invention.

Figure 2:
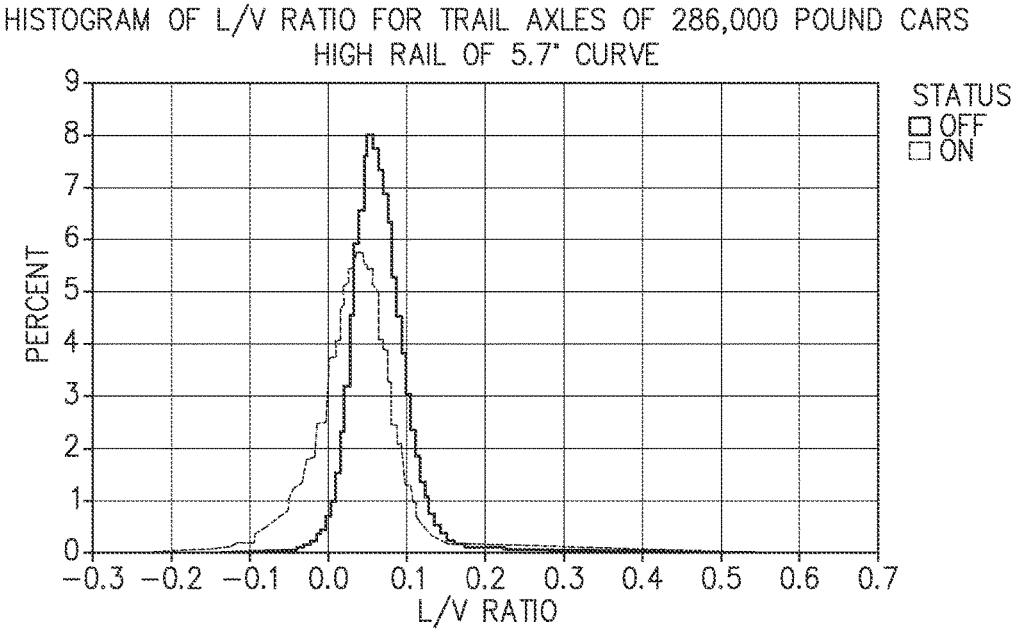
FIG. 2 is a histogram showing L/V ratio on the high rail of a 5.7° curve for trail axles of a dry wheel-rail system and a wheel-rail system comprising a friction control composition in accordance with the present invention.

Referring to FIG. 2, reduction of the lateral forces and achievement of a positive coefficient of friction or friction is shown for use of the friction control composition in accordance with above Example 2. To that end, a dry wheel-rail system is compared with a wheel-rail system having the friction control of the present invention applied in liquid form to the top of the rail as described above.

FIG. 2 shows the distribution of the L/V ratio on the high rail of a 5.7° curve for trail axles of the dry wheel-rail system and the wheel-rail system comprising the friction control composition of Example 2. The friction control composition reduces the lateral forces as indicated by the lower L/V ratio. That is, the composition of Example 2 changes the friction from negative to positive, limits the creep of the wheel on the rail head and reduces the lateral engagement force and/or contact by the wheel flange with the gauge side face of the rail. Accordingly, the L/V ratio is reduced.

It has also been found that the composition of Example 2 tends to limit the variation of the L/V ratio so as to result in a closer grouping of data points. This is also believed to be related to the smoothing of the train travel and increased train stability.

Figure 3:
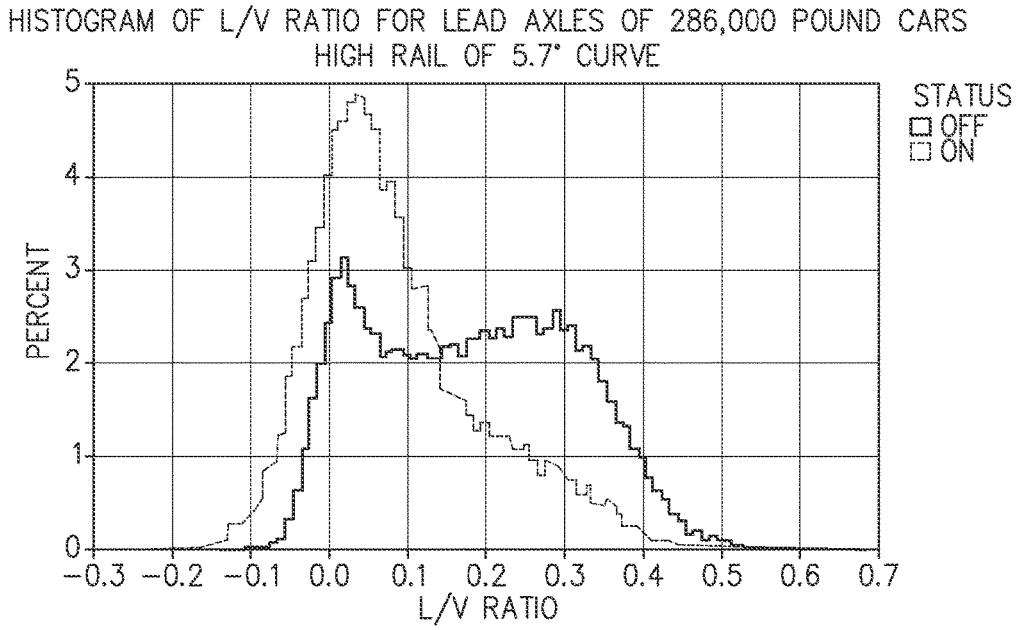
FIG. 3 is a histogram similar to FIG. 2 showing L/V ratio on the high rail of a 5.7° curve for lead axles of a dry wheel-rail system and a wheel-rail system comprising a friction control composition in accordance with the present invention.

Referring to FIG. 3, the L/V ratio is shown for the lead axles of the cars of FIG. 2 for the dry wheel-rail system compared with the wheel-rail system having the friction control composition of Example 2. As stability increases, the L/V ratio for the treated wheel-rail system decreases to values less than those of the dry wheel-rail system.

Figure 4:
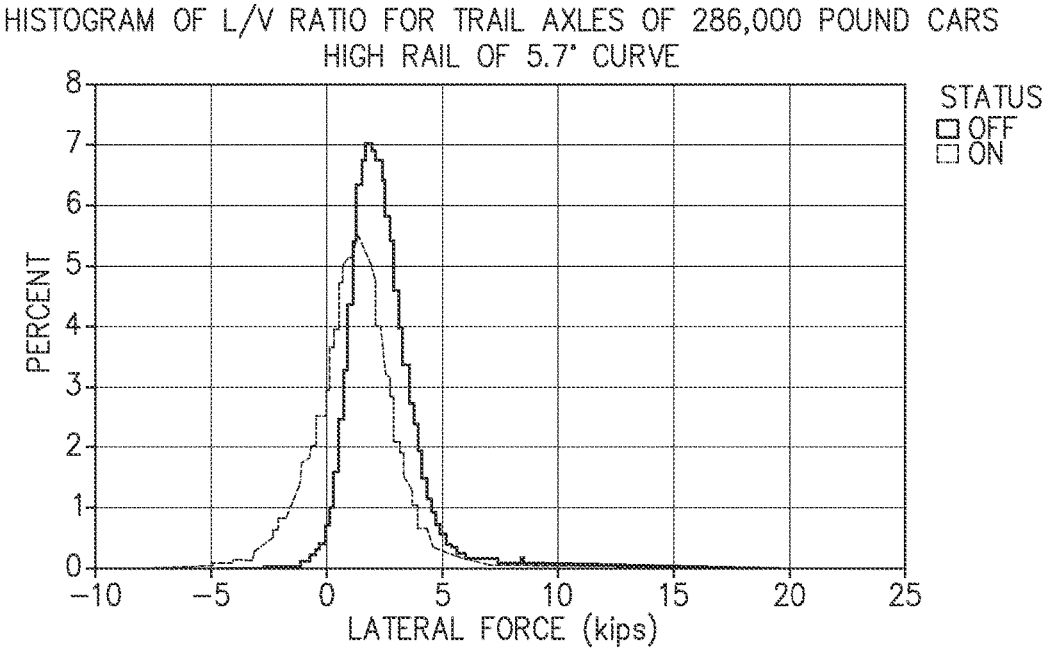
FIG. 4 is a histogram showing lateral force distribution for the trail axles of the wheel-rail systems of FIG. 2
Figure 5:
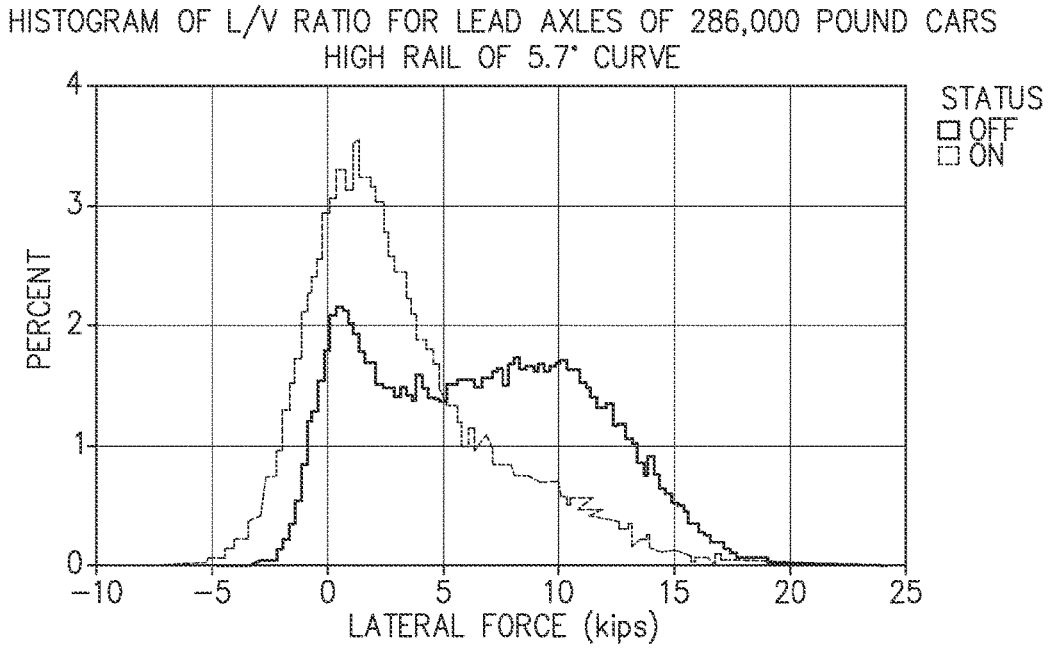
FIG. 5 is a histogram similar to FIG. 4 showing lateral force distribution for the lead axles of the wheel-rail systems of FIG. 2.

Referring to FIGS. 4 and 5, histograms show the lateral force distribution for the trail and lead axles of the train cars of FIGS. 2 and 3. As shown, the lateral forces are reduced.

Figure 6:
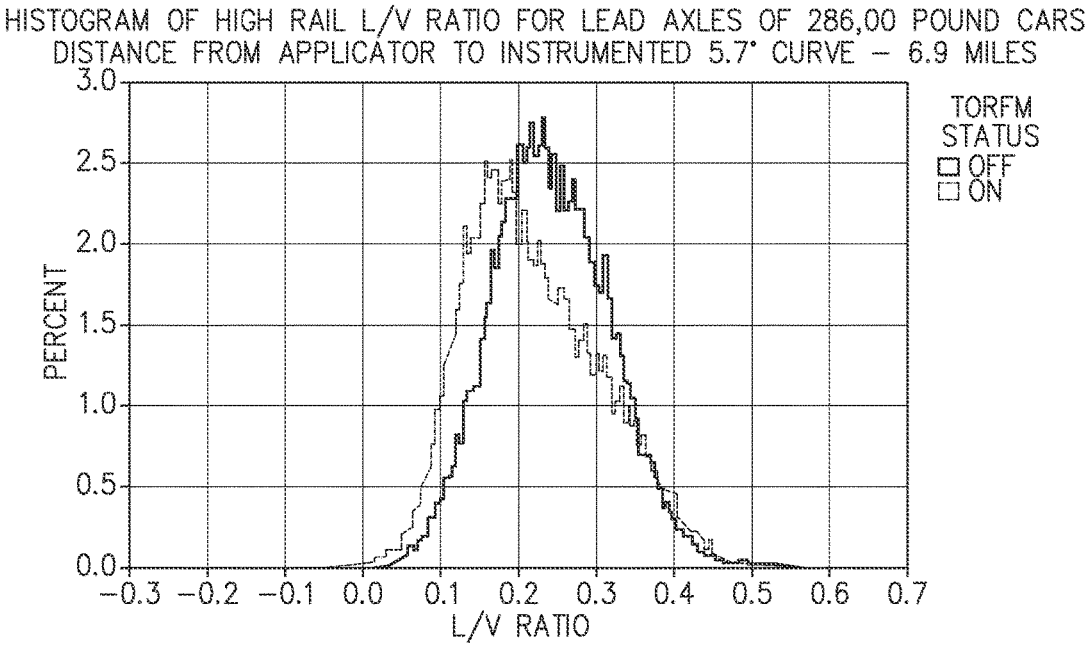
FIG. 6 is a histogram similar to FIG. 2 showing the high rail L/V ratio for lead axles of the wheel-rail systems of FIG. 2 at a distance of 6.9 miles from point of application of the friction control composition.
Figure 7:
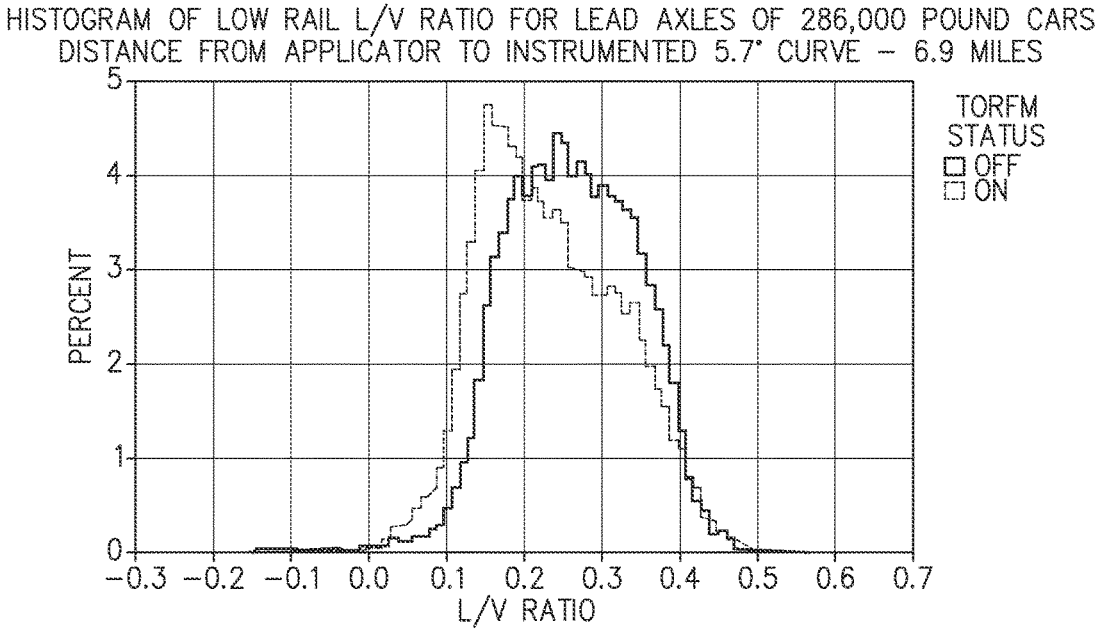
FIG. 7 is a histogram similar to FIG. 6 showing the low rail L/V ratio for lead axles of the wheel-rail systems of FIG. 2 at a distance of 6.9 miles from point of application of the friction control composition.

Referring to FIGS. 6 and 7, the improved "carry down" of the compositions of the invention is shown. As noted above, carry down is how far the friction control composition is carried along the track in an effective amount from the application location. The further down the track the composition is carried the better for the rail road customer since the friction control composition works over a longer distance (e.g. stick-slip and creep are reduced together with the achievement of the other benefits described above.). This can save rail road customers significant money by requiring fewer applicators and also less friction control product.

To that end, the L/V ratios for the wheel-rail systems of FIGS. 2-5 were measured at a distance of 6.9 miles from the point of application and shown in FIGS. 6 and 7. It has been found in third party tests that the friction control compositions disclosed herein have carry down from two to three times further than prior art products. This dramatic increase is surprising to both the third party testers and potential customers.

The present invention has been described with regard to preferred embodiments. However, it will be obvious to persons skilled in the art that a number of variations and modifications can be made without departing from the scope of the invention as described herein. In the specification the word "comprising" is used as an open-ended term, substantially equivalent to the phrase "including but not limited to", and the word "comprises" has a corresponding meaning. Citation of references is not an admission that such references are prior art to the present invention.

What is claimed is:

1. A friction control composition for use on top of rail applications comprising:

(a) from about 4 to about 40 w/w % water;
(b) from about 2 to about 20 w/w % rheology additive;
(c) from about 10 to about 40 w/w % water insoluble component;
(d) from about 10 to about 40 w/w % water soluble polyalcohol freezing point depressant;
(e) from about 9 to about 24 w/w % liquid or solid friction modifier; and
(f) from about 1 to about 20 w/w % liquid or solid lubricant; and wherein said water insoluble component is selected from the group consisting of isoparaffins, vegetable oils, bio-based triglycerides, fatty oils, polyalpha olefins and synthetic esters.

2. The friction control composition of claim 1, comprising:

(a) from about 15 to about 29 w/w % water;
(b) from about 4 to about 13 w/w % rheology additive;
(c) from about 11 to about 28 w/w % water insoluble component;
(d) from about 22 to about 40 w/w % water soluble polyalcohol freezing point depressant;
(e) from about 9 to about 24 w/w % liquid or solid friction modifier; and
(f) from about 1 to about 6 w/w % liquid or solid lubricant.

3. The friction control composition of claim 1, comprising:

(a) from about 24 to about 25 w/w % water;

(b) from about 4 to about 7 w/w % rheology additive;

(c) from about 14 to about 18 w/w % water insoluble component;

(d) from about 22 to about 32 w/w % water soluble polyalcohol freezing point depressant;

(e) from about 14 to about 18 w/w % liquid or solid friction modifier; and (f) from about 2 to about 3 w/w % liquid or solid lubricant.

4. The friction control composition of claim 1, wherein said water insoluble component is selected from the group consisting of isoparaffins and fatty oils.

5. The friction control composition of claim 4, wherein said water insoluble component is selected from the group consisting of C13 to C16 isoalkanes and canola oil.

6. The friction control composition of claim 1, wherein said composition has a viscosity achieved by shear mixing in the range of from about 5,000 cP to about 15,000 cP, and upon termination of shear mixing and return to static conditions, the composition has a static viscosity or cone penetration thickness in the range of from about 300 to about 400 tenths of a millimeter.

7. The friction control composition of claim 1, further comprising one or more of the following:

(g) from 1 to 7 w/w % aprotic solvent exhibiting limited water solubility;

(h) from 0.1 to 4 w/w % corrosion inhibitor; and (i) from 0.05 to 2 w/w % biocide/fungicide agent.

8. The friction control composition of claim 1, further comprising: an aprotic solvent exhibiting limited water solubility, a corrosion inhibitor, a biocide/fungicide agent, carbon black, lime or a combination thereof.

9. The friction control composition of claim 2, wherein said water insoluble component is selected from the group consisting of isoparaffins, canola oil, polyalpha olefins and synthetic esters.

10. The friction control composition of claim 9, further comprising: an aprotic solvent exhibiting limited water solubility, a corrosion inhibitor, a biocide/fungicide agent, carbon black, lime or a combination thereof.

11. A method of modifying the friction of a rail road track from negative to positive comprising:

mixing the friction control composition of claim 1 by applying shear to thin or reduce the thickness or viscosity of the composition;

applying said thinned composition to the top of a rail; and causing said thinned composition on the top of the rail to settle to a static condition of increased viscosity sufficient to maintain the composition in position on the top of the rail as an undried composition for engagement by a train wheel with shear thinning and distribution of the composition along the rail to change the friction from negative to positive.

12. The friction control composition method of claim 11, wherein said thinned composition has a viscosity or cone penetration achieved by shear mixing in the range of from about 5,000 cP to about 15,000 cP, and upon termination of shear mixing and return to static conditions, the composition has a static viscosity or cone penetration thickness in the range of from about 300 to about 400 tenths of a millimeter.

13. The friction control composition of claim 1, for use on top of rail applications consisting essentially of:

(a) from about 4 to about 40 w/w % water;

(b) from about 2 to about 20 w/w % rheology additive;

(c) from about 10 to about 40 w/w % water insoluble component;

(d) from about 10 to about 40 w/w % water soluble polyalcohol freezing point depressant;

(e) from about 9 to about 24 w/w % liquid or solid friction modifier; and (f) from about 1 to about 20 w/w % liquid or solid lubricant; and wherein said water insoluble component is selected from the group consisting of isoparaffins, vegetable oils, bio-based triglycerides, fatty oils, polyalpha olefins and synthetic esters.

14. The friction control composition of claim 13, wherein said composition is free of a skin forming retentivity agent.

15. The friction control composition of claim 14, wherein said composition is free of a skin forming retentivity agent selected from the group consisting of acrylic, polyvinyl alcohol, polyvinyl chloride, oxazoline, epoxy, alkyd, urethane acrylic, modified alkyd, acrylic latex, acrylic epoxy hybrids, polyurethane, styrene acrylate, and styrene butadiene based compounds.

16. A thixotropic gel or liquid for friction control comprising:

(a) from about 4 to about 40 w/w % water;

(b) from about 2 to about 20 w/w % rheology additive;

(c) from about 10 to about 40 w/w % water insoluble hydrocarbon component selected from the group consisting of isoparaffins, vegetable oils, bio-based triglycerides, fatty oils, polyalpha olefins and synthetic esters;

(d) from about 10 to about 40 w/w % water soluble polyalcohol freezing point depressant;

(e) from about 9 to about 24 w/w % liquid or solid friction modifier; and (f) from about 1 to about 20 w/w % liquid or solid lubricant; and wherein the thixotropoic gel or liquid is free of a skin forming retentivity agent.

17. The thixotropic gel or liquid of claim 16, wherein the thixotropic gel or liquid is free of a skin forming retentivity agent selected from the group consisting of acrylic, polyvinyl alcohol, polyvinyl chloride, oxazoline, epoxy, alkyd, urethane acrylic, modified alkyd, acrylic latex, acrylic epoxy hybrids, polyurethane, styrene acrylate, and styrene butadiene based compounds.

18. The thixotropic gel or liquid of claim 16 comprising:

(a) from about 24 to about 29 w/w % water;

(b) from about 2 to about 13 w/w % rheology additive;

(c) from about 11 to about 28 w/w % water insoluble component;

(d) from about 22 to about 40 w/w % water soluble polyalcohol freezing point depressant;

(e) from about 9 to about 24 w/w % liquid or solid friction modifier; and (f) from about 1 to about 6 w/w % liquid or solid lubricant.

19. The thixotropic liquid or gel of claim 16 further comprising one or more of the following:

(a) an aprotic solvent exhibiting limited water solubility;

(b) a corrosion inhibitor; and (c) a biocide/fungicide agent.

20. The thixotropic gel or liquid of claim 16 comprising at least one of the following:

(a) clay as a rheology additive;

(b) canola oil as the water insoluble component;

(c) glycerine as a freezing point depressant; and (d) carbon black and/or molybdenum disulfide as the liquid or solid lubricant.

21. The thixotropic liquid or gel of claim 16 wherein the rheology additive is clay and wherein the clay has receptor sites and the water insoluble component binds onto the clay receptor sites.

* * * * *